US006003854A

United States Patent [19]

Keller

[11] Patent Number: 6,003,854

[45] Date of Patent: Dec. 21, 1999

[54] APPARATUS FOR INDIVIDUALLY SEPARATING STACKED PRINTED PRODUCTS

[75] Inventor: Alex Keller, Hofacfer 3, Switzerland

[73] Assignee: Ferag AG, Hinwil, Switzerland

[21] Appl. No.: 09/027,331

[22] Filed: Feb. 20, 1998

[30] Foreign Application Priority Data

Mar. 4, 1997 [CH] Switzerland ..... 0508/97

[51] Int. Cl.[6] ..... B65H 5/22; B65H 83/00; B65H 85/00; B65H 3/42; B65H 3/30

[52] U.S. Cl. ..... 271/3.01; 271/3.02; 271/3.08; 271/16; 271/21; 271/82; 271/204

[58] Field of Search ..... 271/3.01, 3.02, 271/3.08, 4.04, 16, 18, 18.3, 19, 21, 82, 204, 206, 221, 3.11

[56] References Cited

U.S. PATENT DOCUMENTS

| | | | |
|---|---|---|---|
| 4,550,822 | 11/1985 | Meier . | |
| 4,566,687 | 1/1986 | Faltin | 271/202 X |
| 4,905,818 | 3/1990 | Houseman | 198/803.7 X |
| 5,295,679 | 3/1994 | Reist | 271/182 X |
| 5,388,820 | 2/1995 | Eberle et al. | 2713/277 X |
| 5,398,920 | 3/1995 | Leu . | |
| 5,465,952 | 11/1995 | Eberle et al. | 271/204 |
| 5,542,656 | 8/1996 | Stauber . | |
| 5,664,770 | 9/1997 | Keller . | |
| 5,669,604 | 9/1997 | Hansen | 271/265.01 X |

FOREIGN PATENT DOCUMENTS

| | | |
|---|---|---|
| 19516045 A1 | 5/1995 | Germany . |
| WO 89/07571 | 8/1989 | WIPO . |

*Primary Examiner*—William E. Terrell
*Assistant Examiner*—Kenneth W Bower
*Attorney, Agent, or Firm*—Brinks Hofer Gilson & Lione

[57] ABSTRACT

The holding elements (28), designed as hook-gripper elements (26), are driven in a circulating manner by means of a drive arrangement (44) in a plane at right angles to a stack (16) of printed products that have back margins (20). In the takeover section (46), the cantilever arm (36) of a hook-gripper element (26) comes to bear against the back margin (20) of the topmost printed product (14) of the stack (16). The hook-gripper element is then guided in a sliding manner on the printed product (14) in the direction of a stop, until the hook mouth (38) of the hook-gripper element (26) has seized the back margin (20). From the takeover section up to the transfer of the printed product (14) separated in this way from the stack (16), the direction of movement of the hook-gripper element (26) has a component toward the stop and a component away from the stack (16).

9 Claims, 4 Drawing Sheets

APPARATUS FOR INDIVIDUALLY SEPARATING STACKED PRINTED PRODUCTS

BACKGROUND OF THE INVENTION

The present invention relates to an apparatus for individually separating stacked printed products having a back margin and an edge that is opposite the back margin.

An apparatus of this type is disclosed in U.S. Pat. No. 5,542,656, which discloses a device having suction heads that are anchored on a continuously rotating rotor driven by swivel arms. The swivel arms are driven with regard to their swiveled position by a swivel drive that is superposed on the rotary drive of the rotor such that they enter the takeover point in a pushing operation and leave it in a pulling operation. At the reversal point, the suction heads seize the edge of the respectively topmost product of a stack. Their tilting movement at the reversal point causes the edge of the product seized to be definitely and reliably separated from the neighboring printed product. The edges of the printed products are placed, one after the other, into grippers of a transporting-away device. The edges of the printed products are placed into the grippers by the suction heads that are swivelled during the circulation.

SUMMARY OF THE INVENTION

It is an object of the present invention to develop an apparatus for separating multi-sheet, printed products in particular multiple-sheet, printed products that have a back margin.

This object is achieved by an apparatus that can individually separate stacked multi-sheet printed products having back margins and opposed open edges. The apparatus includes a stop for engaging, at least, the open edges of the topmost multi-sheet printed product. In the preferred embodiment the stop engages the open edges of the entire stack of multi-sheet printed products. A holding element is driven in a circulating manner by a drive arrangement along a closed path of movement in a plane that extends at right angles to the back margins. The closed path of movement includes a takeover section and a transfer section. The apparatus also includes a transporting-away device that receives the individual printed products from the holding element and transports them away for further processing. The holding element includes hook-gripper elements that have cantilever arms with a hook mouths at its free ends. The drive arrangement functions to, move said hook-gripper elements through the takeover section such that said cantilever arm bears against the back margin of the topmost printed product and as the hook-gripper element slides toward the stop until the hook mouth seizes the back margin of the topmost printed product. After seizing the back margin the hook-gripper element has, from the takeover section to the transfer section, a direction of movement that includes a component toward the stop and a component away from the stack.

According to the invention, the printed product to be separated are seized at the back margin by a hook-gripper element and are urged against a stop that is located along the edge opposite the back margin. The relative movement of the hook-gripper element with respect to the stop causes the printed product, to be separated, and bent up such that the back margin is moved in the direction away from the stack. Controlled grippers of a transporting-away device grip the separated printed products along the exposed back margin for the purpose of transporting it away. The holding element, that is designed as a hook-gripper element, is of a particularly simple construction and enables multi-sheet, folded printed products to be processed. The fold forming the back margin or the edge along which the sheets are joined to one another form the back margin of the printed product that is seized by the hook-gripper element. Sheets joined to one another along one edge, for example by stapling or unsewn binding, to form a printed product can also be processed by this invention. The cantilevered arm of the hook-gripper element engages the back margin of the topmost printed product such that, reliable seizing of the back margin by the hook mouth is ensured.

A particularly preferred embodiment of the apparatus includes a hook-gripper element that is constructed such that it has a self springing feature. This embodiment in addition to being an extremely simple design of the hook-gripper element, ensures in a simple way that the hook-gripper element is held in contact with the printed product by force until the hook mouth has seized the back margin.

The preferred embodiment of the hook-gripper element device enables the hook-gripper element to assume an optimum position in the takeover section and to move from there up to the transfer section at which the printed product is separated, in a fashion that ensures reliable seizing and subsequent holding of the printed product.

A particularly simple design of the swivel drive for the apparatus comprises a fixed sun wheel that is coaxial with the rotor for the hook-gripper element, a drive wheel that is connected to the hook-gripper element and a planet wheel mounted to freely rotate on the rotor for the hook-gripper element. The planet wheel meshes with the sun wheel and the drive wheel, both of which have the same diameter.

A further particularly preferred embodiment of the apparatus comprises a control device which when activated causes the hook-gripper element to move to a rest position from which it does not seize the topmost printed product. This embodiment offers the possibility of interrupting the separating without having to stop the drive arrangement. Since the movement of the hook-gripper element is synchronized with the transporting-away device, this offers the possibility of interrupting the transferring of printed products to the transporting-away device although the latter continues to be driven.

The invention is now explained in more detail with reference to an exemplary embodiment represented in the drawing.

BRIEF DESCRIPTION OF THE DRAWINGS

FIG. 1 shows in elevation an apparatus according to the invention, having a stack rest, a transporting-away device and a separator arranged in between.

DETAILED DESCRIPTION OF THE PREFERRED EMBODIMENT

Figure 1:
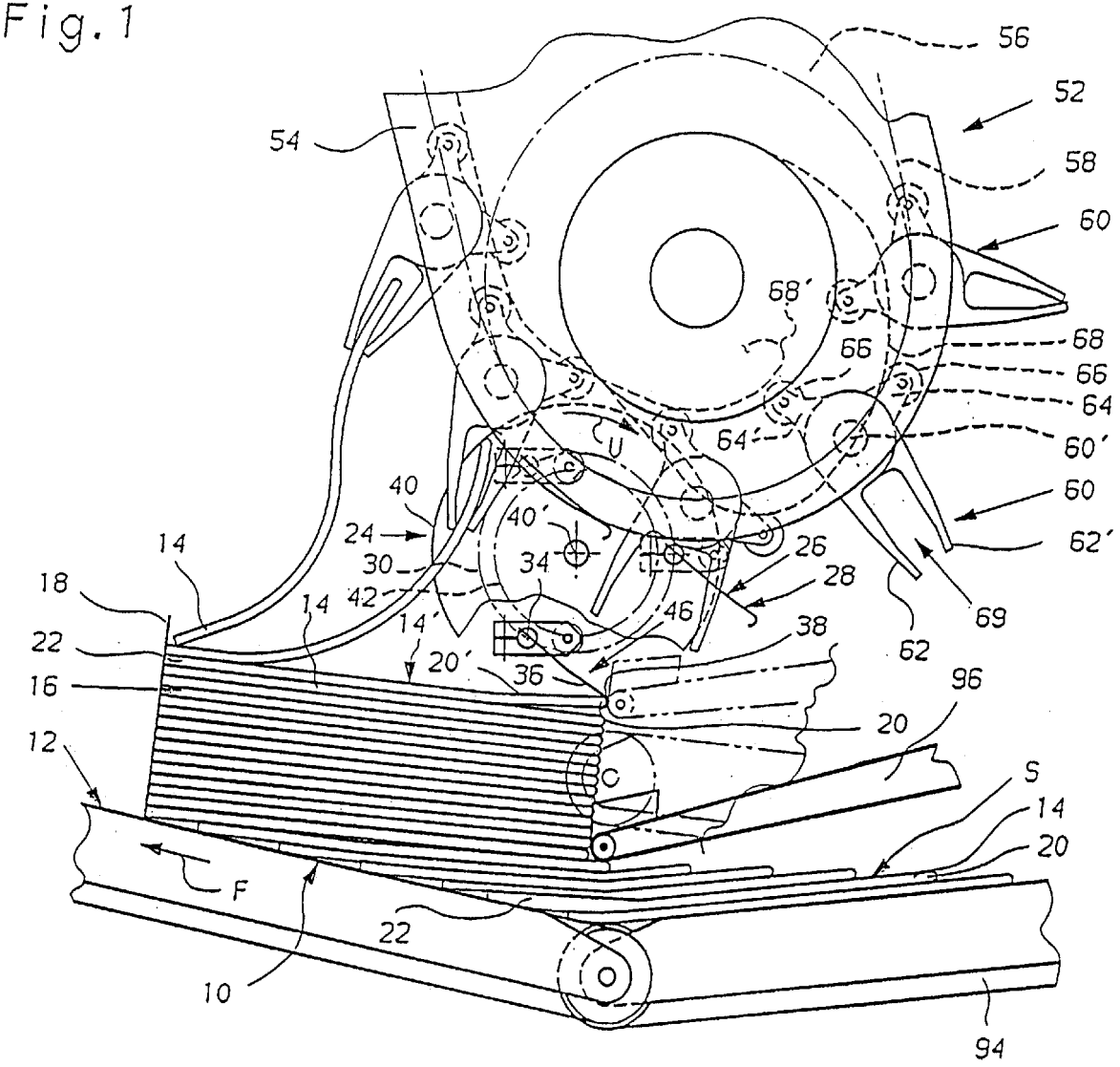

In the apparatus shown in FIG. 1, a stack rest 10 is formed by a belt conveyor 12 which is driven in a circulating manner in conveying direction F and is vertically adjustable in such a way that the topmost printed product 14 of a stack 16 of printed product supported on the stack rest 10 is at a predetermined location. Seen in the conveying direction F, and located downstream of the stack 16 is a fixed stop 18, against which the printed products 14 bear. The printed products 14 are folded multi-sheet products having a folded or back margin 20 and an opposite open edge 22. The opposite open edges 22 of the products 14 bear against the fixed stop 18.

Arranged above the stack rest 10 is a separator 24. As also revealed by FIG. 2, it has three holding elements 28, designed as hook-gripper elements 26, which are driven in a circulating manner along a circular path of circulation 30 in circulating direction U. The path of circulation 30 extends in a plane of circulation which extends at right angles to the edges 20 and 22 of the product and thus the stack 16 and consequently at right angles to the stack rest 10 and parallel to the conveying direction F. The hook-gripper elements 26 are formed by a section of a spring steel strip which is bent at one of its ends in the form of a hook mouth 38. The end region remote from the hook mouth 38 is fastened in a shank 34 in such a way that it forms a self-springing cantilever arm 36, on the free end of which, on the side facing the stack rest 10, is the hook mouth 38. The shanks 34 for the three hook-gripper elements 26 are mounted to be freely rotative on a rotor 40 which is driven continuously in the direction of rotation U, for example by means of a toothed belt 39 connected to a motor, and are kept in a mutually parallel position by means of a swivel drive 42 which is superposed on the rotary drive and is to be described further with reference to FIG. 4. The rotor 40, which has an axis of rotation 40', and the swivel drive 42 form a drive arrangement 44 for the hook-gripper elements 26.

In a region of their path of circulation 30 below the axis 40' of the rotor 40, the hook-gripper elements 26 run through a takeover section 46. Seen in this takeover section 46, the shank 34 is arranged in a forward position with respect to the hook mouth 38 and the cantilever arm 36 is arranged in a rearwardly and obliquely downwardly extending working position 48 with respect to the shank 34. The cantilever arm 36 forms with a horizontal an angle $\alpha$ which is preferably between 10 and 70°, in particular between 25 and 60° and most preferred about 40°.

Figure 2:
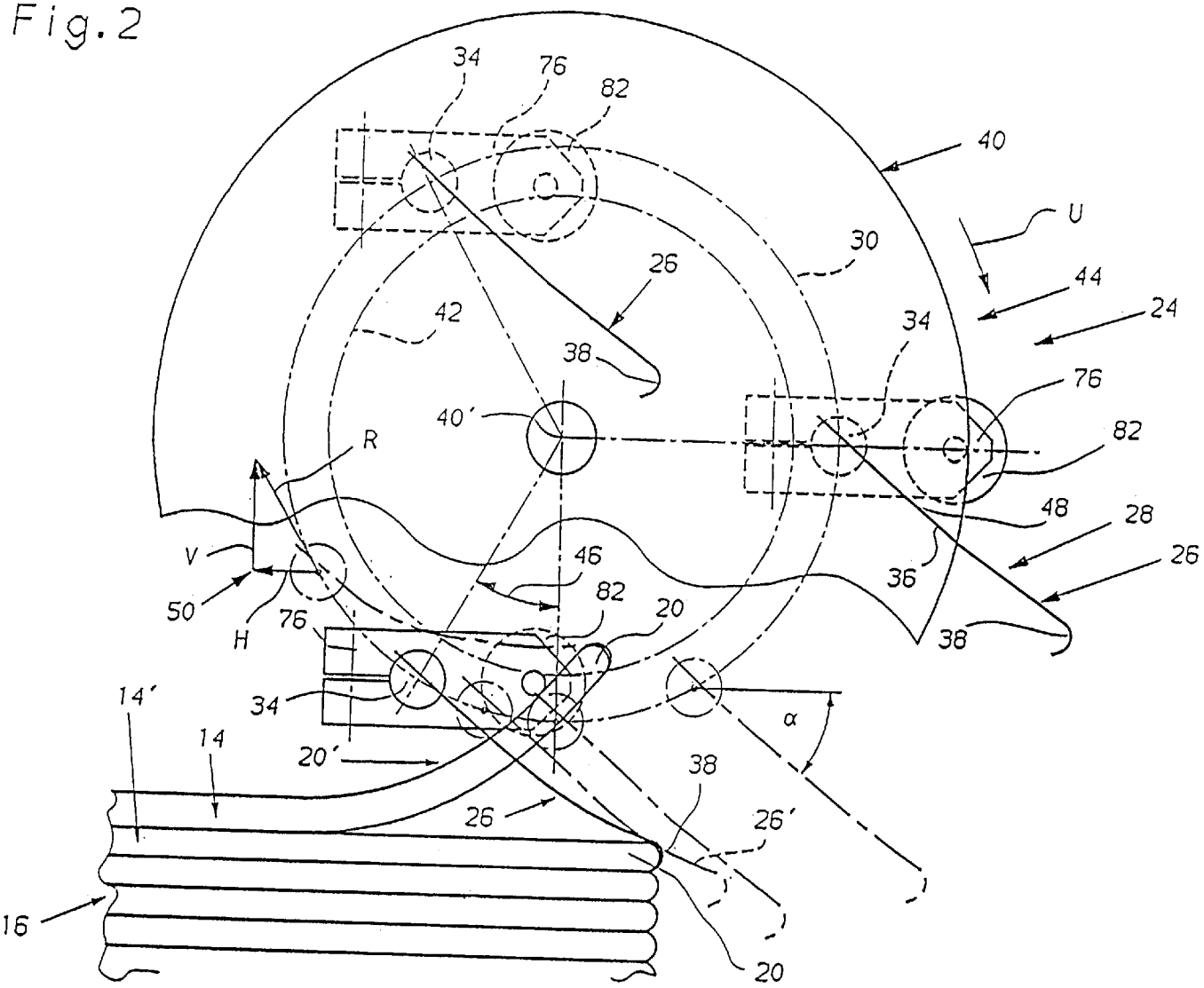
FIG. 2 shows in elevation the separator shown in FIG. 1 at different points in time during the separating of a printed product from the stack.

The topmost printed product 14 of the stack 16 is arranged with respect to the path of circulation 30 in such a way that a hook-gripper element 26 comes to bear with its cantilever arm 36 against the back margin 20 of this printed product 14 while it runs through the takeover section 46. At the same time, the shank 34 concerned is approximately vertically below the axis 40' of the rotor 40, with the result that the hook-gripper element 26 concerned is moved with a main component of its force in the direction toward the stop 18 (FIG. 1). In the course of the further movement, the cantilever arm 36 is guided in a sliding manner on the back margin 20 of the topmost printed product 14 and is at the same time bent in the manner of a leaf spring by the counteracting force of the stack 16, with the result that a component of its force is directed against product 14. This, is best illustrated in FIG. 2 where the position of the hook-gripper element is indicated by dash-dotted lines and denoted by 26'. This ensures the reliable seizing of the topmost printed product 14 at the back margin 20 by means of the hook mouth 38, as is indicated in FIG. 2 by the hook-gripper element 26 shown by solid lines at the end of the takeover section 46. From the takeover section 46 to a transfer section 50 for the separated printed products 14, the hook-gripper elements 26 are moved along the path of circulation 30 in a direction R which has a horizontal component H pointing toward the stop 18 and a component V pointing in a vertical direction upward away from the stack 16. This movement of the shank 34 concerned has the result that the topmost printed product 14, held by means of the hook mouth 38, is separated from the stack 16 with the back margin 20 ahead, in that it is bent such that the region of the printed product 14 adjacent back margin 20 that is designated 20' extends in the upward direction. However, movement of the printed product 14 in the direction H is prevented by means of the stop 18.

Also shown in FIG. 1 is the transporting-away device 52 which is located above the stack rest 10. The transporting-away device 52 has an endless drawing member 58, which is guided in a known manner in a guide channel 54 and is deflected around a deflecting wheel 56. The transporting-away device 52 includes a plurality of controlled grippers 60 that are arranged at constant intervals one behind the other. The grippers 60 move along a path of movement 61 in a plane which extends parallel to the path of circulation 30. The gripper jaws 62, 62', which are prestressed in the closing direction by means of a spring (not shown), are able to swivel about a gripper axis 60', which extends at right angles to the plane of movement of the grippers 60. On each of the gripper jaws 62, 62' there is fastened a lever 64, 64', which bears a roller 66 at its free end. Arranged fixedly alongside the deflecting wheel 56 are two guides 68, 68', which are intended for the purpose of interacting with the rollers 66 assigned to the levers 64 and 64', respectively, in order to swivel the gripper jaws 62, 62' during the deflection about the deflecting wheel 56 and in the subsequently following section of the guide channel 54 into a desired position or to keep it in the swiveled position concerned. Before the grippers 60 reach the transfer section 50, they are brought into the open position by opposed movement of the gripper jaws 62, 62' and are swiveled in such a way that the gripper mouth 69 is pointing substantially in the downward direction, with the result that the topmost printed product 14, that has been separated from the stack 16 by the separator 24, can be introduced, with its back margin 20 leading, between the gripper jaws 62, 62' into the opened gripper mouth 69. At the downstream end of the takeover section 46, the grippers 60 are closed by swiveling the gripper jaws 62, 62' toward each other, in order to transport away the printed product 14 that is held by the grippers 60.

Figure 3:
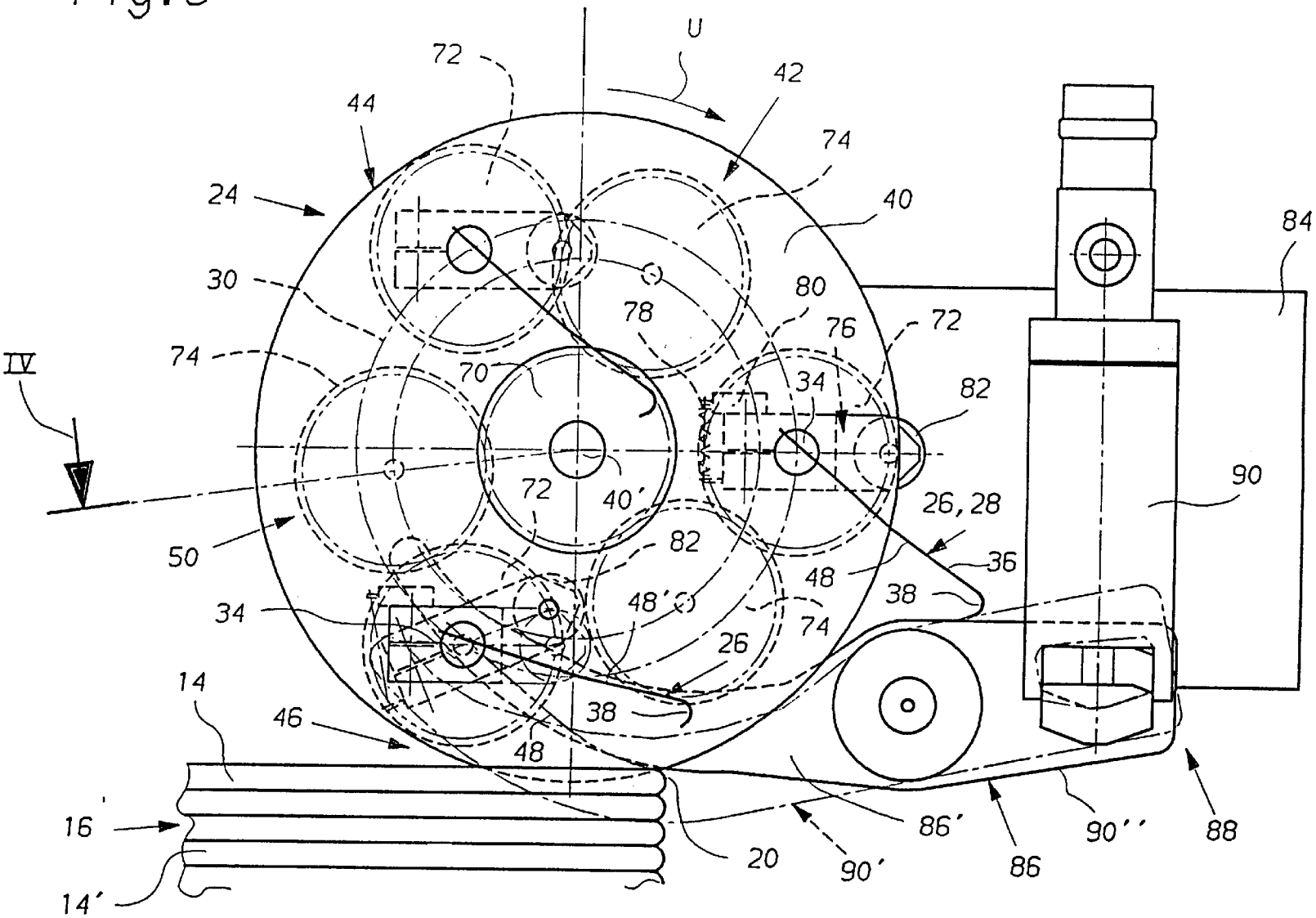
FIG. 3 likewise shows in elevation the separator shown in FIGS. 1 and 2, having a swivel drive for the hook-gripper elements and a control device for swiveling the hook-gripper elements into a position of rest.
Figure 4:
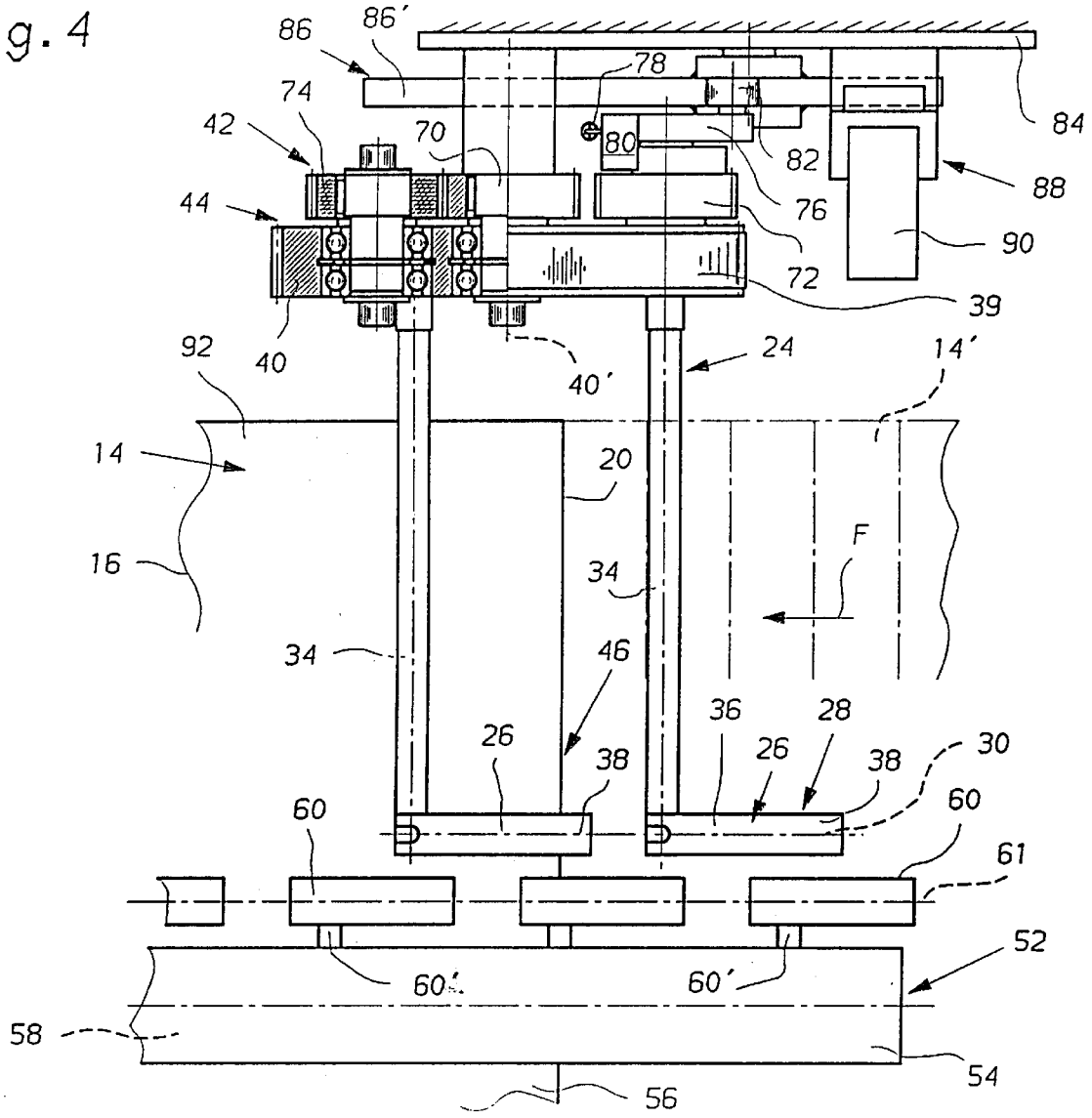
FIG. 4 shows in plan view, and partial section view taken along the line denoted in FIG. 3 by IV, the separator and the transporting-away device.

As can be seen from FIGS. 3 and 4, the swivel drive 42 has a fixed sun wheel 70, which is arranged coaxially with respect to the rotor axis 40'. On the shanks 34, that are uniformly distributed on a circle that is concentric with rotor axis 40', a drive wheel 72 is mounted for free rotation. For each drive wheel 72 there is, mounted on the rotor 40, a planet wheel 74, which meshes on the one hand with the drive wheel 72 concerned and on the other hand with the sun wheel 70. Since the diameter of the drive wheels 72 is equal to the diameter of the sun wheel 70, when the rotor 40 rotates in the direction of rotation U, the drive wheels 72 rotate counter to this direction in such a way that they retain their swiveled position unchanged.

On each of the shanks 34 there is seated in a rotationally fixed manner a two-arm stop lever 76, which is held by means of a tension spring 78 with one arm bearing against a counter-stop 80. This counter-stop 80 is fixedly arranged on the drive wheel 72 concerned. At the end of the stop lever 76 opposite the counter-stop 80, a control roller 82 is mounted in a freely rotatable manner. On the machine frame 84, on which the rotor 40 is rotatably mounted, there is also a double-arm control lever 86 of a control device 88 that is arranged such that it can swivel. This lever 86 can be swivelled by a quick-operating cylinder-piston unit 90, that is supported on the machine frame 84, from a passive position 90', indicated by dash-dotted lines, into an active position 90", indicated by solid lines. The lever arm 86' of the double-arm control lever 86 which is remote from the cylinder-piston unit 90 is designed in the manner of a guide on its upper side facing the rotor axis 40'. In the passive position 90', the control lever 86 is outside the path of movement of the control rollers 82. If, however, the control lever 86 swivels into the active position 90", the control rollers 82 run onto the lever arm 86' from above, whereupon the stop lever 76 and, together with the latter, the hook-gripper elements 26 are swiveled counterclockwise against the force of the tension spring 78. This takes place before the hook-gripper elements 26 runs into the takeover section 46 and is retained while they run through the takeover section 46. In the active position 90" of the control lever 86, the hook-gripper element 26 running through the takeover section 46 assumes an approximately horizontal position of rest 48', whereby it is ensured that the hook mouth 38 moves past the back margin 20 of the topmost printed product 14 at a distance above it. As a result, the topmost printed product 14 is not separated from the stack 16 by this hook-gripper element 26. Approximately when it reaches the transfer section 50, the control roller 82 assigned to the hook-gripper element 26 concerned lifts off the lever arm 86', whereby the hook-gripper element 26 is swiveled back into the working position 48 again under the force of the tension spring 78.

The distance between successive shanks 34 and the control lever 86 are coordinated with one another in such a way that there is only one control roller 82 in the region of the lever arm 86' and consequently the control lever 86 can be changed over from one position to the other while none of the control rollers 82 is in its region.

As seen in FIG. 4, which is a view looking in a direction that is at a right angle to the conveying direction F, the path of movement 61 of the grippers 60 extends centrally between the side edges 92 of the stack 16. The path of circulation 30 of the hook-gripper elements 26 extends laterally offset with respect to that in the direction of the drive arrangement 44, although the distance between the hook-gripper elements 26 and the grippers 60 is to be advantageously kept as small as possible. To make this possible, the guide channel 54 for the drawing member 58, is arranged on the side opposite the path of circulation 30 with respect to the path of movement of the grippers 60.

Arranged upstream of the belt conveyor 12, (see FIG. 1) in conveying direction F, is a feeding conveyor 94 that is connected to the belt conveyor 12 in the manner of a knee joint. The feeding conveyor 94 like the belt conveyor 12 is shown as a belt conveyor. Arranged above the feeding conveyor 94 is a circulating pressure-exerting belt 96, which together with said conveyor forms in the region of the joint connection with the belt conveyor 12 a conveying gap for the fed-in printed products 14. These are transported in conveying direction F, lying in an imbricated formation S on the feeding conveyor 94, each printed product 14 in the imbricated formation S resting on the one following it and the back margin 20 trailing with respect to the opposite edge 22. The printed products 14 are consequently transported in conveying direction F with the open edge 22 ahead, feeding the stack 16 from below, until they are up against the stop 18. The interaction of the pressure-exerting belt 96 with the feeding conveyor 94 and belt conveyor 12 ensures that, in this arrangement, the printed products 14 are conveyed up to the stop 18.

The belt conveyor 12 is mounted such that it can swivel with its end away from the feeding conveyor 94 about a horizontal axis. In a known way, the swiveled position of the belt conveyor 12 can be set in such a way that the topmost printed product 14 of the stack 16 is in each case at a predetermined height with the back margin 20 at the takeover section 46. If folded printed products 14 are to be processed, the height adjustment by swiveling the stack rest 10 has the advantage of automatically compensating for the greater thickness of the printed products at the back margin 22 in comparison with the thickness at the edge 22, with the result that in each case the topmost printed product 14 assumes approximately a horizontal position irrespective of the height of the stack.

On average, the stack rest 10 is fed as many printed products 14 as there are printed products 14 separated from the stack 16. However, the stack takes on a buffering function, with the result that, in the short term, differences in feeding and separating can be absorbed.

If, in principle, a printed product 14 is to be separated each time a hook-gripper element 26 runs through the takeover section 46, it is possible to dispense with the control device 88. In this case, the drive wheels 72 are connected in a rotationally fixed manner to the shank 34 concerned. The stop lever 76, the tension spring 78 and the counter-stop 80 are in this case also not necessary.

It is also conceivable to design the hook-gripper elements 26 with flexurally rigid cantilever arms. In this case, the tension spring 78 can take on the function of urging the hook-gripper elements 26 against the topmost printed product 14 to be separated. However, if suitable damping measures are not taken, this may have the result that the apparatus does not run smoothly. For the sake of completeness, it should be mentioned in this connection that, in the case of the embodiment shown in the figures, the torque exerted by the tension spring 78 is greater than that of the hook-gripper element 26. As a result, when control lever 86 has been swiveled into the passive position 90', the stop lever 76 always remains up against the counter-stop 78, which contributes to the smooth running of the apparatus.

It is conceivable to swivel the hook-gripper elements 26 in a suitable manner by means of a correspondingly designed swivel drive.

The hook-gripper element 26 may be provided at its end on the hook mouth side with, for example, needle-like points, which are intended for the purpose of piercing into the back margin 20 of the printed product 14 respectively to be separated. Furthermore, the hook mouth 38 may be differently designed, in a way corresponding to the shape of the back margin 20 of the printed products 14 to be processed.

What is claimed is:

1. An apparatus for individually separating stacked multi-sheet printed products having back margins (20) and open edges (22) that are opposite said back margins, comprising:

a stop for engaging the open edges of the topmost multi-sheet printed product;

a holding element (28) that is driven in a circulating manner by means of a drive arrangement (44) along a closed path of movement (30) in a plane at right angles to said back margins of the stacked printed products, said closed path of movement including a takeover section and a transfer section;

a transporting-away device;

said holding element including a hook-gripper element (26) having a cantilever arm (36) with a hook mouth (38) arranged at its free end;

said drive arrangement functions to, move said hook-gripper element (26) through the takeover section such that said cantilever arm bears against the back margin (20) of the topmost printed product (14) as said hook-gripper element slides toward said stop until said hook mouth (38) seizes the back margin (20) of said topmost printed product;

said hook-gripper element subsequent to seizing the back margin of the topmost printed product has, from the takeover section (46) to the transfer section (50), a direction of movement (R) with a component (H) toward the stop (18) and a component (v) away from the stack (16).

2. The apparatus as claimed in claim 1, wherein the hook-gripper element (26) is of a self-springing design.

3. The apparatus as claimed in claim 1, which comprises a control device (88), which in the activated state moves the hook-gripper element (24) from a working position (48) into a rest position (48'), in which, when it runs through the takeover section (46), it moves past the topmost printed product (14) without seizing it.

4. The apparatus as claimed in claim 1, which comprises a number of hook-gripper elements (26) arranged one behind the other in the circulating direction (U).

5. The apparatus as claimed in claim 1, wherein the transporting-away device (52) has a multiplicity of controlled grippers (60) arranged at intervals one behind the other on a closed drawing member (58), the path of movement (61) of the grippers (60), directed with the gripper mouth (69) substantially downward in the transfer section (50), runs above said stacked multi-sheet printed products and is laterally offset with respect to the path of circulation (30) of the hook-gripper element (26), and wherein the grippers (60) are arranged on the side of the drawing member (58) facing the path of circulation (30).

6. The apparatus as claimed in claim 1, wherein a stack rest (10) is formed by a conveyor (12) that feeds the stack (16) from below, and the conveyor (12) is vertically adjustable and is dependent on the feeding in of printed products (14') to the stack (16) and the progressing individual separation, such that the topmost printed product (14) is located at the takeover region (46).

7. The apparatus as claimed in claim 1, wherein the drive arrangement (44) has a rotor (40), on which the hook-gripper element (26) is mounted, said rotor having a rotor axis, and a swivel drive (42) which is superposed on the rotary drive and keeps the hook-gripper element (26) in a rearwardly and obliquely downwardly directed position (48) with respect to the circulating direction (U) in the takeover section (46) and from the takeover section up to the transfer section (50).

8. The apparatus as claimed in claim 7, wherein said swivel drive (42) has a fixed sun wheel (70), which is coaxial with respect to the rotor axis (40'), a drive wheel (72), which is connected to the hook-gripper element (26), and a planet wheel (74), which is mounted freely rotatably on the rotor (40) and meshes with the sun wheel (70) and the drive wheel (72), and the sun wheel (70) and the drive wheel (72) preferably have the same diameter.

9. The apparatus as claimed in claim 8, wherein the hook-gripper element (26) is fastened to a shank (34) which is mounted freely rotatably in the rotor (40) and has a stop lever (76), said stop lever (76) is held by means of a spring (78) up against a counter-stop (80) of said swivel drive (42) which determines the working position (48) of the hook-gripper element (26) and is arranged on the drive wheel (72), and a control device (88) including a control element (86), that is of a lever-like design, and which can be moved into an activated state (90") at which it acts, in the takeover section (50) on the shank (34), through the stop lever (76), to swivel the stop lever (76) away from the counter-stop (80), counter to the spring action (78), and thereby swivel the hook-gripper element (26) into the position of rest (48').

* * * * *